US007274798B2

(12) United States Patent
Ohashi et al.

(10) Patent No.: US 7,274,798 B2
(45) Date of Patent: Sep. 25, 2007

(54) SPEAKER DEVICE

(75) Inventors: Yoshio Ohashi, Kanagawa (JP); Masaru Uryu, Chiba (JP); Naotaka Tsunoda, Tokyo (JP); Takeshi Hara, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/515,853

(22) PCT Filed: May 28, 2003

(86) PCT No.: PCT/JP03/06700

§ 371 (c)(1),
(2), (4) Date: Aug. 11, 2005

(87) PCT Pub. No.: WO03/101148

PCT Pub. Date: Dec. 4, 2003

(65) Prior Publication Data

US 2006/0088184 A1 Apr. 27, 2006

(30) Foreign Application Priority Data

May 28, 2002 (JP) ..... 2002-154499

(51) Int. Cl.
*H04R 25/00* (2006.01)

(52) U.S. Cl. ..... 381/430; 381/398; 381/423

(58) Field of Classification Search ..... 381/398, 381/401, 402, 407, 423, 424, 430, 412; 181/157, 181/161, 163, 164, 165, 171, 172
See application file for complete search history.

(56) References Cited

U.S. PATENT DOCUMENTS 4,132,872 A 1/1979 Inoue
6,359,996 B1 * 3/2002 Ohashi ..... 381/401
6,578,661 B2 * 6/2003 Ohashi et al. ..... 181/161
2002/0061117 A1 * 5/2002 Takewa et al. ..... 381/430
2006/0072777 A1 * 4/2006 Ohashi et al. ..... 381/430

FOREIGN PATENT DOCUMENTS

| | | |
|---|---|---|
| DE | 28 12 222 | 10/1978 |
| EP | 1 207 719 | 5/2002 |
| GB | 1 586 907 | 3/1981 |
| JP | 47-30443 | 9/1972 |
| JP | 53-119023 | 10/1978 |
| JP | 61-072995 | 5/1986 |
| JP | 2000-156896 | 6/2000 |
| JP | 2001-346291 | 12/2001 |
| WO | WO 00/32012 | 6/2000 |

* cited by examiner

*Primary Examiner*—Huyen Le
(74) *Attorney, Agent, or Firm*—Finnegan, Henderson, Farabow, Garrett & Dunner, L.L.P.

(57) ABSTRACT

A loudspeaker device 1 includes an acoustic diaphragm 5 composed of a domed diaphragm 11, an edge-like diaphragm 13, and a junctional flat portion 12 which joins those domed and edge-like diaphragms, and a joined portion 23 where an end surface of a bobbin 4 of a voice coil or of a conductive 1-turn ring 3 is stuck and fixed to the junctional flat portion 12 or a reinforcement ring 15; and the reinforcement ring 15 is stuck and fixed to the junctional flat portion 12 from above or from under, thereby increasing the mechanical strength of the junctional flat portion 12 of the acoustic diaphragm 5. A loudspeaker device in which unnecessary vibrations are removed and also the quality of acoustic signals is excellent up to high range is provided.

15 Claims, 9 Drawing Sheets

SPEAKER DEVICE

TECHNICAL FIELD

The present invention relates to a loudspeaker device used for audio equipment, video equipment, or various pieces of other equipment, and particularly to a loudspeaker device in which the strength of a junctional flat portion of an acoustic diaphragm is increased.

BACKGROUND ART

As shown, for example, in FIG. 12, an acoustic diaphragm in a conventional loudspeaker device has a domed diaphragm 121 shaped like a dome in the center, and an edge-like diaphragm 129 which is integrally formed with the domed diaphragm 121 and extending from the circular periphery of the domed diaphragm 121 using a polymer film, metal or the like, such that the edge-like diaphragm 129 has a predetermined curvature of concavity or convexity or is linear in cross section.

A voice bobbin 122 on which a voice coil 123 is wound is joined to a junctional portion where the domed diaphragm 121 and edge-like diaphragm 129 of an acoustic diaphragm 120 are integrated such that the voice bobbin 122 hangs down, and the voice coil 123 is provided to be capable of oscillating up and down as a driving means in a gap 127 which forms a magnetic space.

A frame that constitutes a loudspeaker includes a ring-shaped magnet 124 provided on a disk-like lower surface plate 135 made of metal, a columnar pole piece 125 erected approximately in the center of the lower surface plate 135, a ring-shaped upper surface plate 126 made of metal mounted on the magnet 124, and a cylindrical frame 130 with which the outer circumferential edge of the edge-like diaphragm 129 is fixed; and the voice coil 123 is disposed in the gap 127 formed between the inner circumference of the upper surface plate 126 and the outer circumference of the pole piece 125 to constitute an dynamic loudspeaker device.

When an acoustic signal has been input into a signal input line 128 of a loudspeaker device having such structure, the voice coil 123, which is provided in a magnetic field of the gap 127, generates driving force for oscillating up and down in the gap 127, and emits the acoustic signal by vibrating the acoustic diaphragm 120.

Regarding such a dynamic loudspeaker device as described above, a conventional method of joining the bobbin 122 and the acoustic diaphragm 120 is, for example, shown in FIG. 13. FIG. 13 shows an enlarged view of the part A in FIG. 12, and one end of the cylindrical bobbin 122 on the opposite side to the side where the voice coil 123 is wound is stuck to a domed diaphragm inner circumferential edge portion 133 of the domed diaphragm 121 of the acoustic diaphragm 120 with an adhesive 131.

The acoustic diaphragm 120 is provided continuously to a diaphragm periphery 134, having a curved cross section of convexity or linear cross section, of the edge-like diaphragm 129, through a junctional flat portion 132, which forms a junctional portion vertically bent from the lower end of the domed diaphragm inner circumferential edge portion 133 that is bent downward from the periphery of the domed diaphragm 121, and the diaphragm periphery 134 is fixed to the cylindrical frame 130.

On the other hand, regarding dynamic electromagnetic induction loudspeakers, one having a structure in which a conductive 1-turn ring is wound instead of the voice coil 123 wound on the bobbin 122, and one having a structure in which an upper end of a cylindrical conductive 1-turn ring of a uniform diameter is directly stuck to the domed diaphragm inner circumferential edge portion 133 of the acoustic diaphragm 120 with the adhesive 131 are being proposed.

According to the above-mentioned dynamic loudspeakers or dynamic electromagnetic induction loudspeakers which are compact and capable of reproduction up to high range (for example, to 100 kHz), the acoustic diaphragm 120 including the domed diaphragm 121 and the edge-like diaphragm 129 is obtained by being integrally formed with a thin metal sheet of, such as aluminum, titanium, or with a polymer sheet; consequently, the metal sheet or polymer sheet of the junctional flat portion 132 joining the domed diaphragm 121 and the edge-like diaphragm 129 becomes thin, because the sheet is stretched in both the directions of the domed diaphragm 121 and of the edge-like diaphragm 129, which are opposite to each other, when being formed, hence there is an inconvenience in which mechanical strength lowers.

In addition, if the bobbin 122 shown in FIG. 13 or the conductive 1-turn ring is stuck to the domed diaphragm inner circumferential edge portion 133 and an acoustic signal is input, at a predetermined frequency the domed diaphragm 121 and the edge-like diaphragm 129 generate vibrations respectively whose phase are different by 180 degrees with each other, with the thin, mechanically weak junctional flat portion 132 as a node. On this frequency there has been an inconvenience in which an acoustic signal emitted from the domed diaphragm 121 and an acoustic signal emitted from the edge-like diaphragm 129 cancel out with each other, causing a dip in acoustic pressure. Particularly, if the dip is in the audible band, there is an inconvenience in which the quality of acoustic signals deteriorates.

Further, at a high frequency of 20 kHz or more, driving force from the bobbin 122 or from the conductive 1-turn ring is absorbed by the adhesive 131 and the mechanically weak junctional flat portion 132, so that the driving force is not transmitted to the edge-like diaphragm 129. Thus, a problem in which the necessary acoustic pressure cannot be obtained at a high frequency of 20 kHz or more remains to be solved.

In order to solve the above problems, the inventors of the present invention previously proposed in Japanese Published Patent Application No. 2001-346291 a loudspeaker device in which the mechanical strength of the junctional flat portion 132 is increased by applying the adhesive 131 across the overall width of the junctional flat portion 132 of the acoustic diaphragm 120, and fixing the bobbin 122 to the junctional flat portion 132, as shown in FIG. 14.

Moreover, also a case in which a conductive 1-turn ring 141 shown in FIG. 15 is used as a driving means is disclosed in the above-mentioned gazette. In order for the conductive 1-turn ring 141 to diminish electric resistance thereof, the width t of the end surface thereof is made larger than that of the bobbin 122. In this case, when the width t' of the junctional flat portion 132, which joins the domed diaphragm 121 and the edge-like diaphragm 129, is approximately equal to the width t of the end surface of the conductive 1-turn ring 141, the mechanical strength of this part further increases.

As described in detail in the above FIG. 14, if the width t of the end surface of the bobbin 122 is smaller than the width t' of the junctional flat portion 132, reinforcement is required with the adhesive 131; however, in this case, the strength varies depending on the application condition of the adhesive 131.

In addition, to enlarge the width t' of the junctional flat portion 132 to a great extent causes a problem in terms of design. For example, if the width t of the conductive 1-turn ring 141 is intended to fit the width t' of the junctional flat portion 132, the magnetic space, namely the width of the gap 127 needs to be enlarged as well, causing an inconvenience in which acoustic pressure sensitivity is lessened.

The present invention is to resolve the above-mentioned problems, and provides a loudspeaker device in which a reinforcement ring is joined to a junctional flat portion or in the vicinity of the junctional flat portion of an acoustic diaphragm to increase the strength of the junctional flat portion, so that vibrations of a domed diaphragm and an edge-like diaphragm that are different in phase by 180 degrees with each other are removed, and driving force from a driving means such as a voice coil is transmitted to the acoustic diaphragm to obtain the excellent quality of acoustic signals up to high range.

DISCLOSURE OF INVENTION

According to a loudspeaker device, which is compact and capable of reproduction up to high range, of the present invention, a reinforcement ring is fixed to a flat portion or to the flat portion including the vicinity thereof, where a domed diaphragm in the center and an edge-like diaphragm of a diaphragm used for an dynamic loudspeaker and an dynamic electromagnetic induction loudspeaker are joined; and an end surface of a voice coil bobbin or an end surface of a conductive 1-turn ring is stuck to the flat portion of the acoustic diaphragm or of the reinforcement ring to increase the mechanical strength of a flat portion.

According to the loudspeaker device of the present invention, since the junctional flat portion or the vicinity of the junctional flat portion of the acoustic diaphragm or of the reinforcement ring is reinforced with the reinforcement ring, the strength of the mechanically weak junctional flat portion, which joins the domed diaphragm and the edge-like diaphragm, increases, so that vibrations of the domed diaphragm and the edge-like diaphragm that are different in phase by 180 degrees with each other are removed and driving force from the coil bobbin is transmitted to the edge-like diaphragm, which enables reproduction to be performed up to high range (to 100 kHz, for example).

BEST MODE FOR CARRYING OUT THE INVENTION

Figure 1:
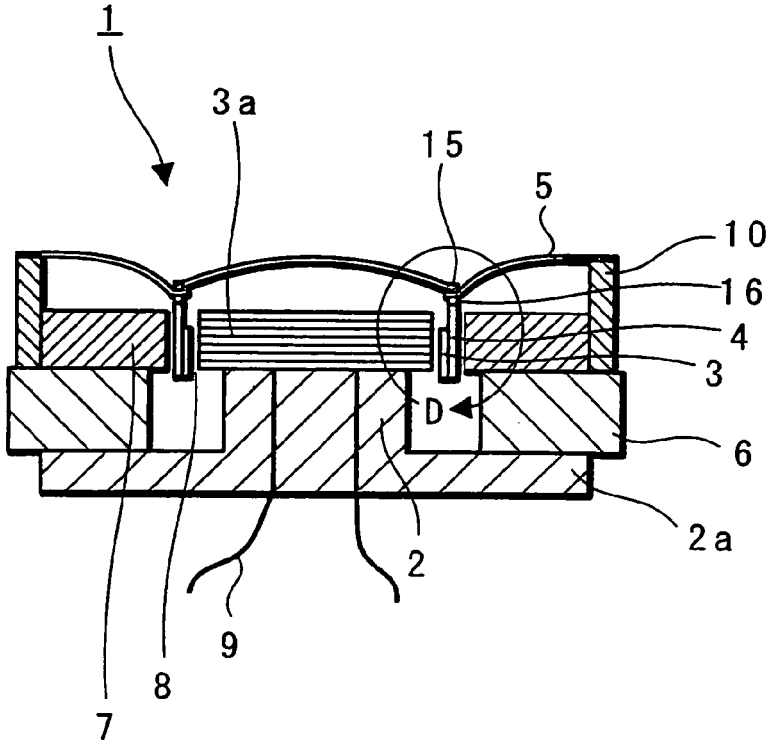
FIG. 1 is a sectional side view showing a first embodiment of a loudspeaker device according to the present invention.
Figure 2:
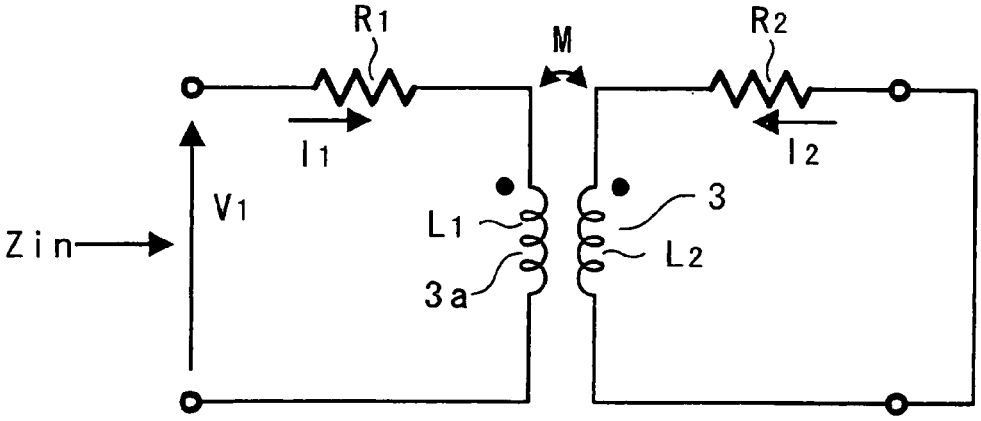
FIG. 2 is an explanatory view showing an operation of FIG. 1.

Hereinafter, each embodiment of a loudspeaker device of the present invention is explained referring to drawings. FIG. 1 is a sectional side view in which the present invention is applied to a dynamic electromagnetic induction loudspeaker, and FIG. 2 shows an equivalent circuit of the dynamic electromagnetic induction loudspeaker shown in FIG. 1.

In FIG. 1, a loudspeaker device 1 includes a frame portion, an acoustic diaphragm and a driving means.

As regards the frame, a columnar pole piece 2 whose diameter is smaller than that of a lower surface plate is integrally formed with a lower surface plate 2*a* formed of a disk-like metal and is erected approximately in the center of the lower surface plate 2*a*, and a concentric magnet 6 is joined to the lower surface plate 2*a* to surround the outer circumference of the pole piece 2.

Further, a disk-like metal upper surface plate 7 concentrically formed is joined onto the magnet 6. The frame portion is constructed by combining a cylindrical frame 10, which has been fitted around the periphery of the upper surface plate 7, with the upper surface plate 7.

As described later on, an acoustic diaphragm 5 includes a convex domed diaphragm in the center and an edge-like diaphragm such that the edge-like diaphragm has a curvature R in cross section or is linear from the periphery of the domed diaphragm.

As regards the driving means of the electromagnetic induction type loudspeaker, when a primary excitation coil 3*a* insulated and wound on the pole piece 2 or on a disk-like pole piece plate (not shown in the figure) fixed on the pole piece 2 and a conductive 1-turn ring 3 fitted to the inner circumference of a bobbin 4 hanging down from an later-described junctional flat portion of the acoustic diaphragm 5 in a gap 8 formed along the inner circumference of the upper surface plate 7 are disposed opposing each other to be capable of electromagnetic induction, and a driving current such as an acoustic input signal is applied through a signal input line 9, an electric current flowing through the primary excitation coil 3*a* changes, causing a magnetic field by the magnet 6 and by the primary coil excitation 3*a* to change, so that an induction current flows through the conductive 1-turn ring 3, and the conductive 1-turn ring 3 oscillates up and down because of electromagnetic power, as a result making the acoustic diaphragm 5 vibrate correspondingly.

FIG. 2 shows an equivalent circuit of an inductive portion of the dynamic electromagnetic induction loudspeaker shown in FIG. 1; when an voltage $V_1$ equivalent to an acoustic input signal is applied to a resistance $R_1$ and an inductance $L_1$ on the primary side of an input impedance Zin which are equivalent to the primary excitation coil 3*a* shown in FIG. 1, an electric current $I_1$ flows, and an electric current $I_2$ equivalent to an output signal flows through a resistance $R_2$ and an inductance $L_2$ on the secondary side which are equivalent to the conductive 1-turn ring 3 by means of induction by a mutual inductance M, so that the driving force for oscillating conductive 1-turn ring 3 up and down is generated, thereby making an acoustic signal emitted from the acoustic diaphragm 5.

Hereinafter, a method for attaching an acoustic diaphragm and a driving means will be explained, using FIGS. 3 through 6.

Figure 3:
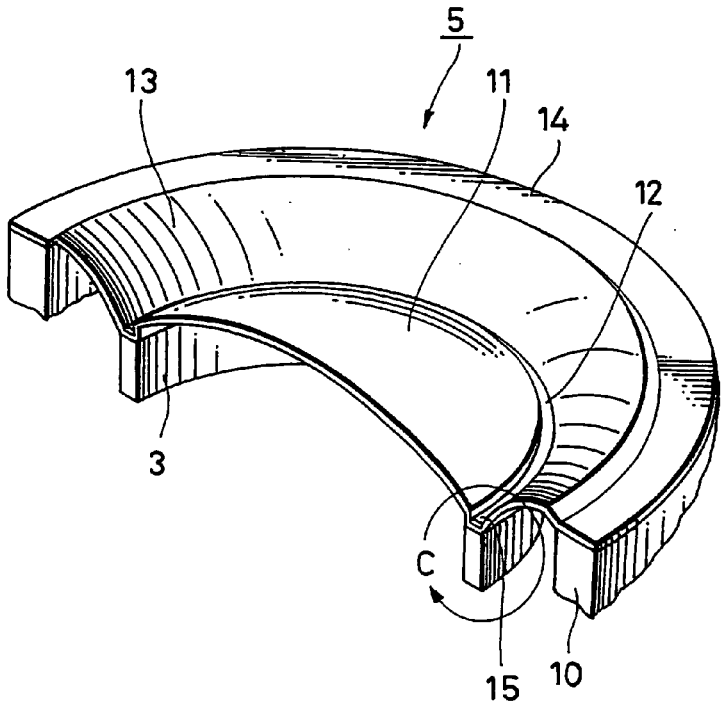
FIG. 3 is a partly cross-sectional perspective view showing a second embodiment of a loudspeaker device according to the present invention.
Figure 15:
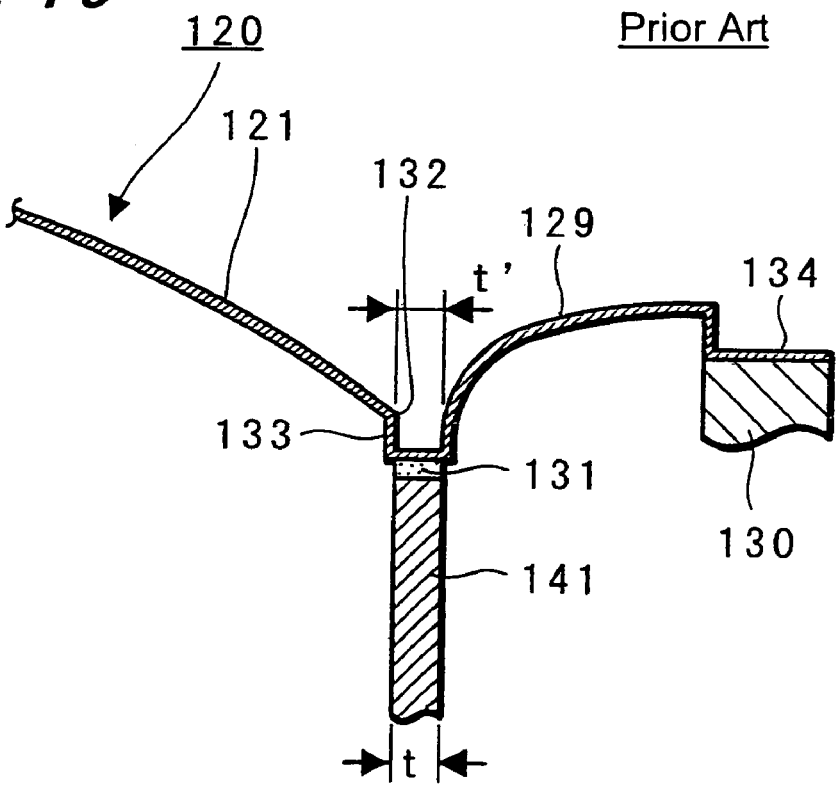
FIG. 15 is an enlarged sectional side view showing further another construction of the part A in FIG. 12.

FIG. 3 is a perspective view in which part of an acoustic diaphragm 5 and part of a conductive 1-turn ring that is a driving means are shown in cross section, and including the same driving means (conductive 1-turn ring only) as shown in FIG. 15; and the acoustic diaphragm 5 is constructed as a single unit by pressing and processing a metal material such as a sheet-like material of aluminum, titanium or the like, or a sheet-like material made of a polymer material, and includes an approximately hemispherical domed diaphragm 11 in the center thereof, a junctional flat portion 12 continuing from the outer circumference of the domed diaphragm 11, an edge-like diaphragm 13 continuing from the outer circumference of the junctional flat portion 12 and having an approximately arc-shaped or straight-line cross section, and a diaphragm periphery 14 constituting an edge attached to a cylindrical frame 10 formed continuously from an outer circumference of the edge-like diaphragm 13.

Figure 5B:
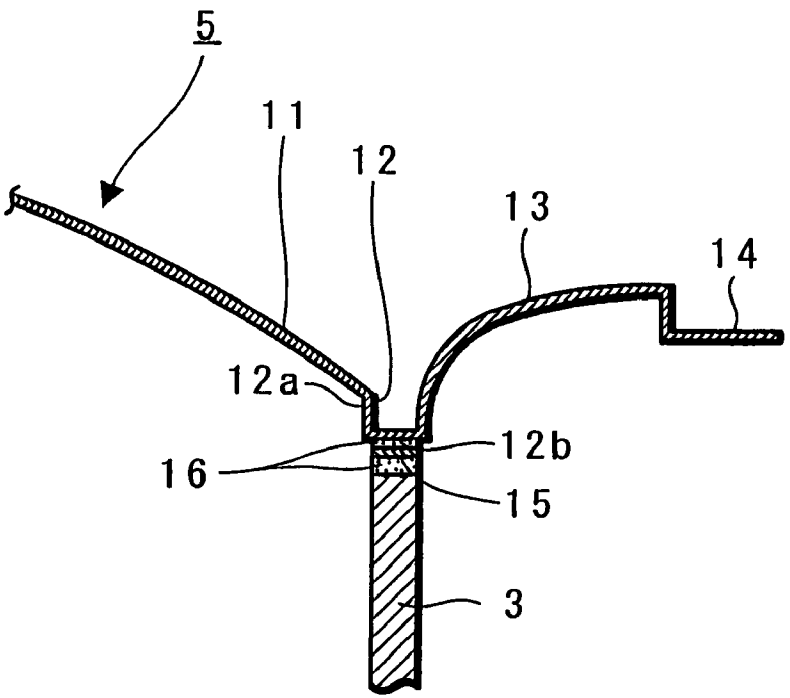
FIGS. 5A and 5B are enlarged sectional side views showing enlarged cross-section of a part C in FIG. 3 and showing other attaching method.
Figure 5A:
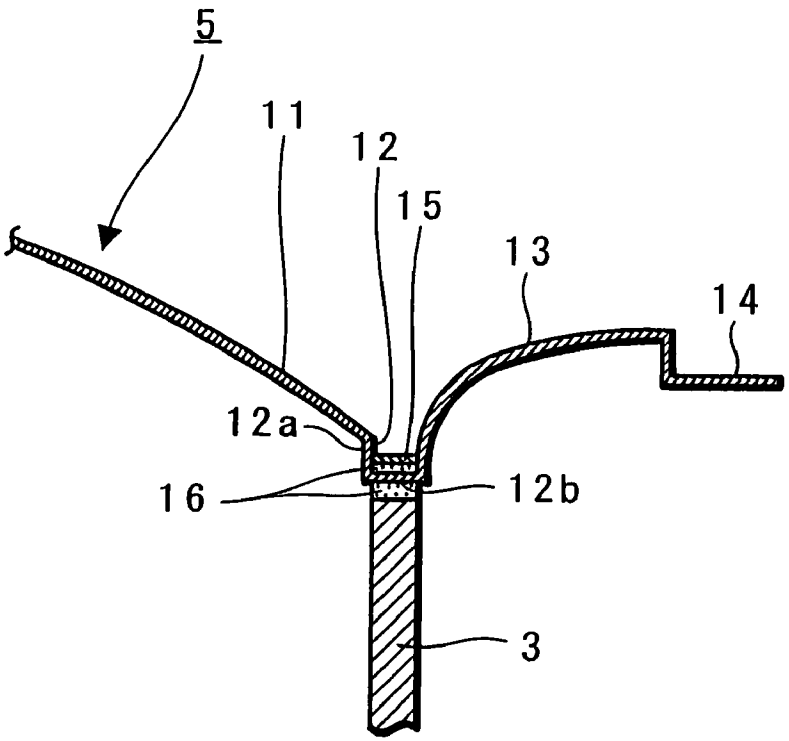

The junctional flat portion 12 which joins the above-mentioned domed diaphragm 11 of the acoustic diaphragm 5 and the edge-like diaphragm 13 includes, as shown in FIGS. 5A and 5B, a ring-shaped domed diaphragm inner circumferential edge portion (hereinafter described as inner circumferential portion) 12*a*, which extends and hangs down from the outer circumference of the domed diaphragm 11; a flat portion 12*b* extended in the horizontal direction at the bottom edge of the inner circumferential portion 12*a*; and the edge-like diaphragm 13 continuously formed at the end edge of the flat portion 12*b*.

When integrally formed by means of a press processing, the flat portion 12*b* of the above-mentioned junctional flat portion 12 is stretched in both the directions of the domed diaphragm 11 and of the edge-like diaphragm 13, thereby being thinly pressed.

Figure 6B:
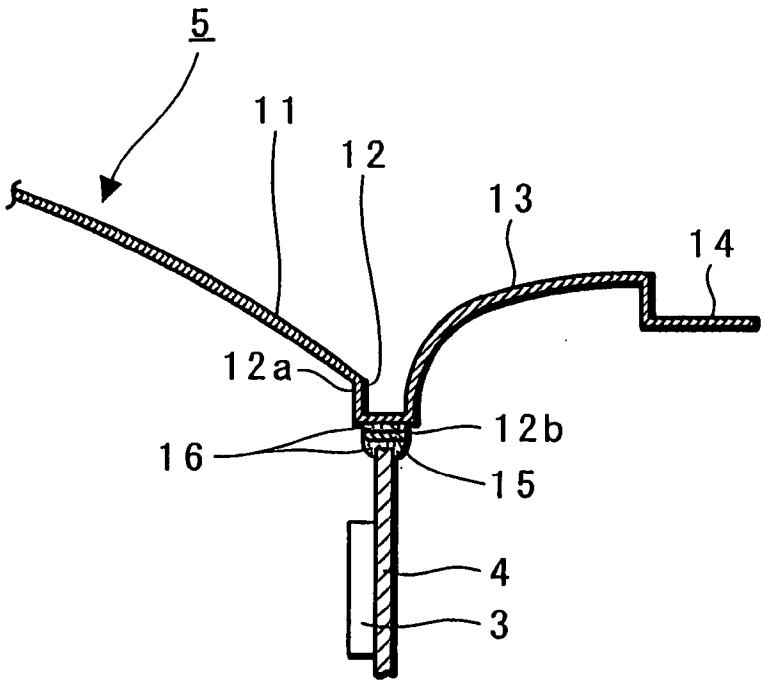
FIGS. 6A and 6B are enlarged cross-sectional views showing enlarged views of a part D in FIG. 1 and showing other attaching method.
Figure 6A:
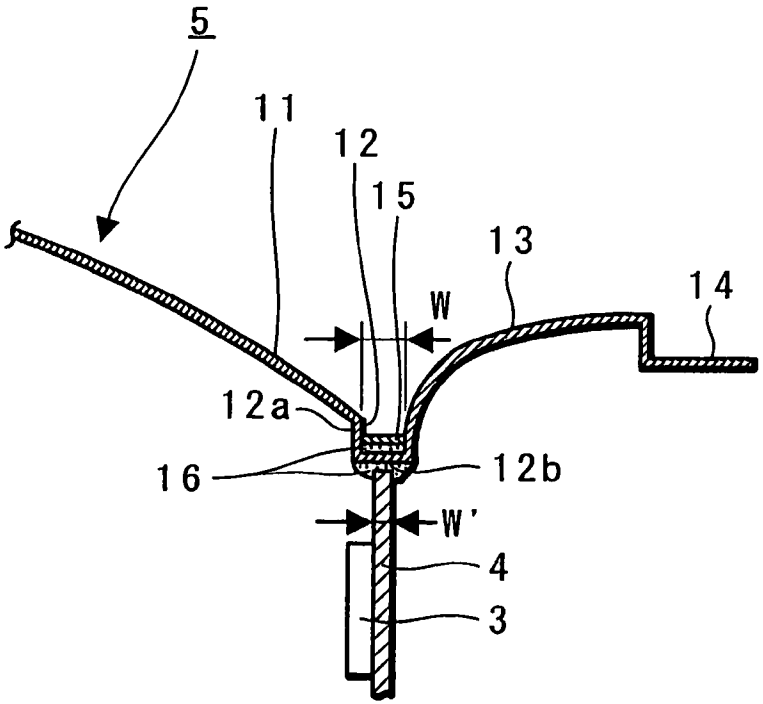

Further, in an dynamic electromagnetic induction loudspeaker, as a coil on the secondary side that is a driving means, the conductive 1-turn ring 3 as shown in FIG. 3 and FIGS. 5A and 5B, or the bobbin 4, on an inner circumference of which a conductive 1-turn ring 3 is attached as shown in FIG. 1 and FIGS. 6A and 6B is joined to the lower surface of the flat portion 12*b* with an epoxy resin adhesive 16. In order to lighten the vibration system, the above bobbin 4 and conductive 1-turn ring 3 are made of an extremely light sheet that is as thin as possible. Thus, the thickness of the end surface of the bobbin 4 or that of the conductive 1-turn ring 3 is smaller than the width of the flat portion 12*b* of the junctional flat portion 12, so that an reinforcing effectiveness cannot be obtained at one end surface of the bobbin 4 and at that of the conductive 1-turn ring 3 joined to the flat portion 12*b* by the adhesive 16.

Figure 4:
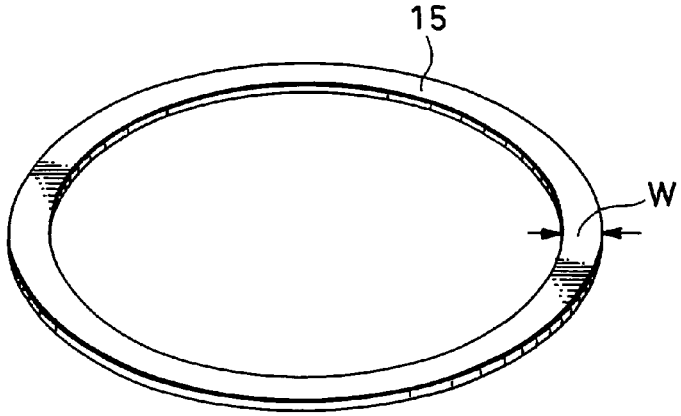
FIG. 4 is a perspective view showing a first embodiment of a reinforcement ring used for a loudspeaker device of the present invention.

Accordingly, in the present invention, as shown in FIGS. 3 through 6, the flat portion 12*b* is reinforced, using such a reinforcement ring 15 as shown in FIG. 4, regarding the junctional flat portion 12.

Specifically, with the width w of the reinforcement ring 15 shown in FIG. 4, which is formed of an aluminum, titanium, polymer or other sheet, or of paper or the like, fitting to the width of the flat portion 12*b* of the junctional flat portion 12 shown in FIGS. 3 and 5A and FIGS. 1 and 6A, the reinforcement ring 15 is stuck and fixed to the junctional flat portion 12 which forms a depression shaped like a concave groove with the adhesive 16 or the like in between, thereby increasing the mechanical strength of the junctional flat portion 12. The material of the reinforcement ring may be the same as that of the acoustic diaphragm 5 and may be otherwise. If the material used is the same as that of the acoustic diaphragm 5, it is desirable that the thickness thereof be greater than that of the acoustic diaphragm 5. If the material used is different from that of the acoustic diaphragm 5, such thickness with which the strength of the adhered part is twice or more greater than that of the material of the acoustic diaphragm 5 is desirable.

At the flat portion 12*b* of the junctional flat portion 12 shown in FIGS. 5B and 6B, the reinforcement ring 15 shown in FIG. 4 is joined to the flat portion 12*b* of the junctional flat portion 12 from under (from the bottom side of) the flat portion 12*b* with the adhesive 16 in between, and further, one end of the conductive 1-turn ring 3 or one end of the bobbin 4 on which the conductive 1-turn ring 3 is attached is joined to the reinforcement ring 15 with the adhesive 16 in between.

In FIGS. 5A and 5B and FIGS. 6A and 6B, such a case in which the reinforcement ring 15 is joined to the flat portion 12*b* of the junctional flat portion 12 from above or from under has been explained; however, it should be noted that both from above and from under a reinforcement ring 15 of a predetermined thickness made of a predetermined kind of material may be joined to reinforce the flat portion 12*b*.

Figure 12:
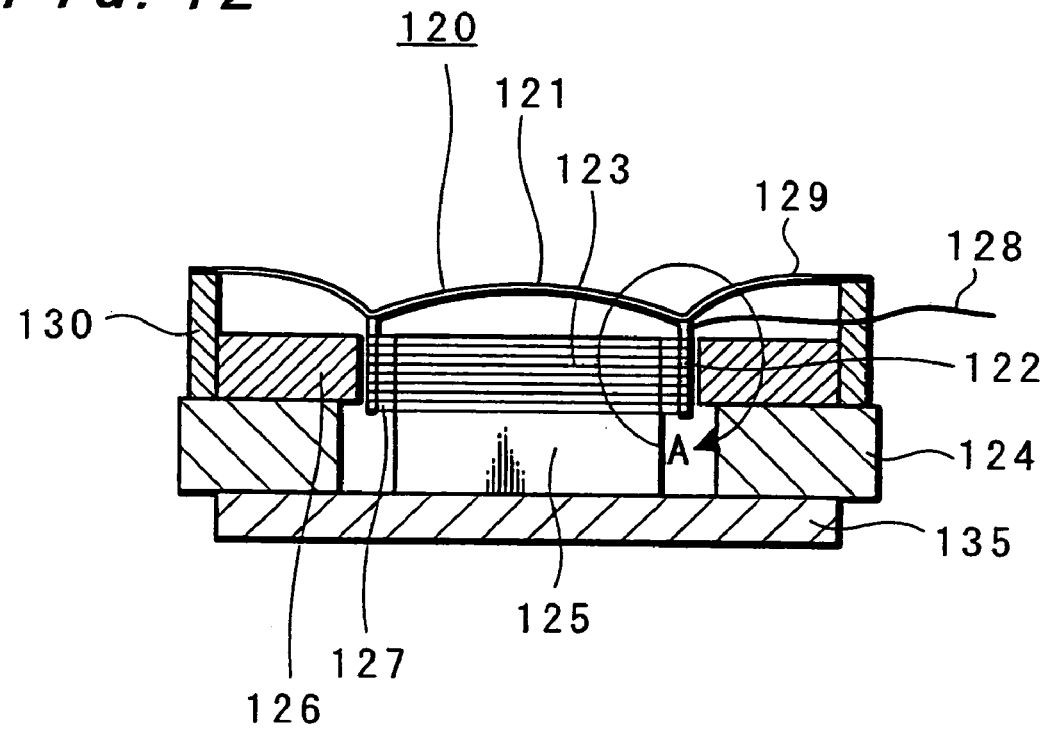
FIG. 12 Prior Art
FIG. 12 is a sectional side view of a conventional loudspeaker device.
Figure 13:
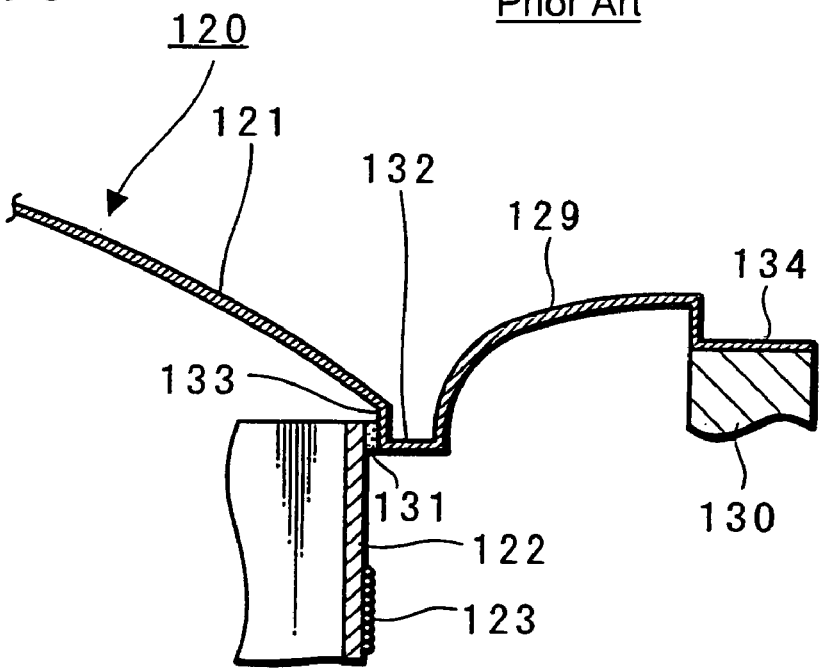
FIG. 13 Prior Art
FIG. 13 is an enlarged sectional side view of a part A in FIG. 12.

In addition, as a driving means of a loudspeaker, an electromagnetic induction type loudspeaker has been explained; however, as shown in FIG. 12, it should be noted that the present invention can obviously be applied to a dynamic loudspeaker as well, in which a voice coil is wound around a conventional bobbin.

Figure 7:
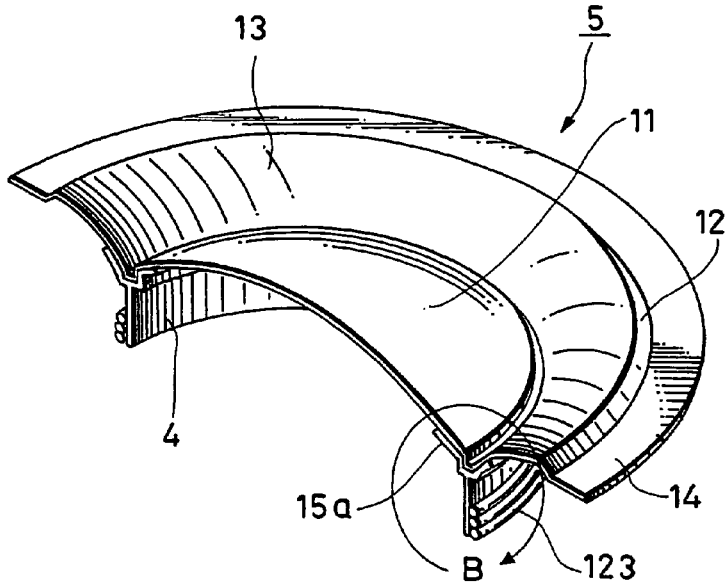
FIG. 7 is a partly cross-sectional perspective view showing a third embodiment of a loudspeaker device according to the present invention.
Figure 8:
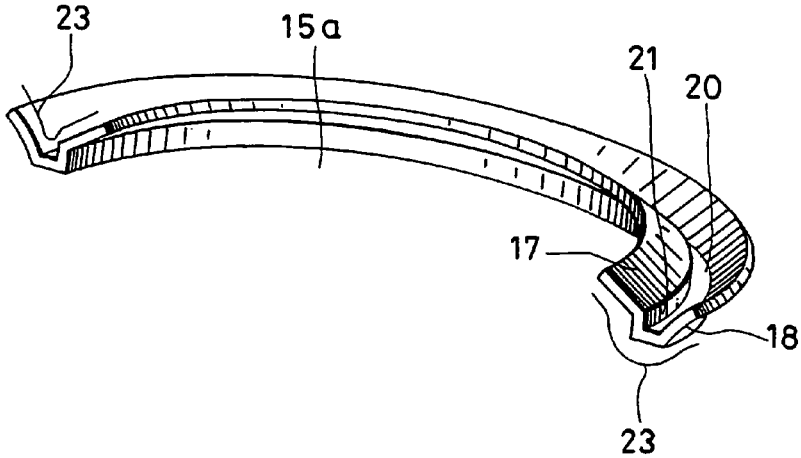
FIG. 8 is a perspective view showing a second embodiment of a reinforcement ring used for a loudspeaker device of the present invention.

Further, another construction of the present invention will be explained, using FIGS. 7 through 9. FIG. 7 is a partly cross-sectional perspective view showing a diaphragm and bobbin of another construction when the present invention is applied to an dynamic loudspeaker; FIG. 8 is a partly cross-sectional perspective view showing another construction of a reinforcement ring used for the present invention, and FIG. 9 is a sectional side view showing another construction of the part B in FIG. 7.

Figure 9:
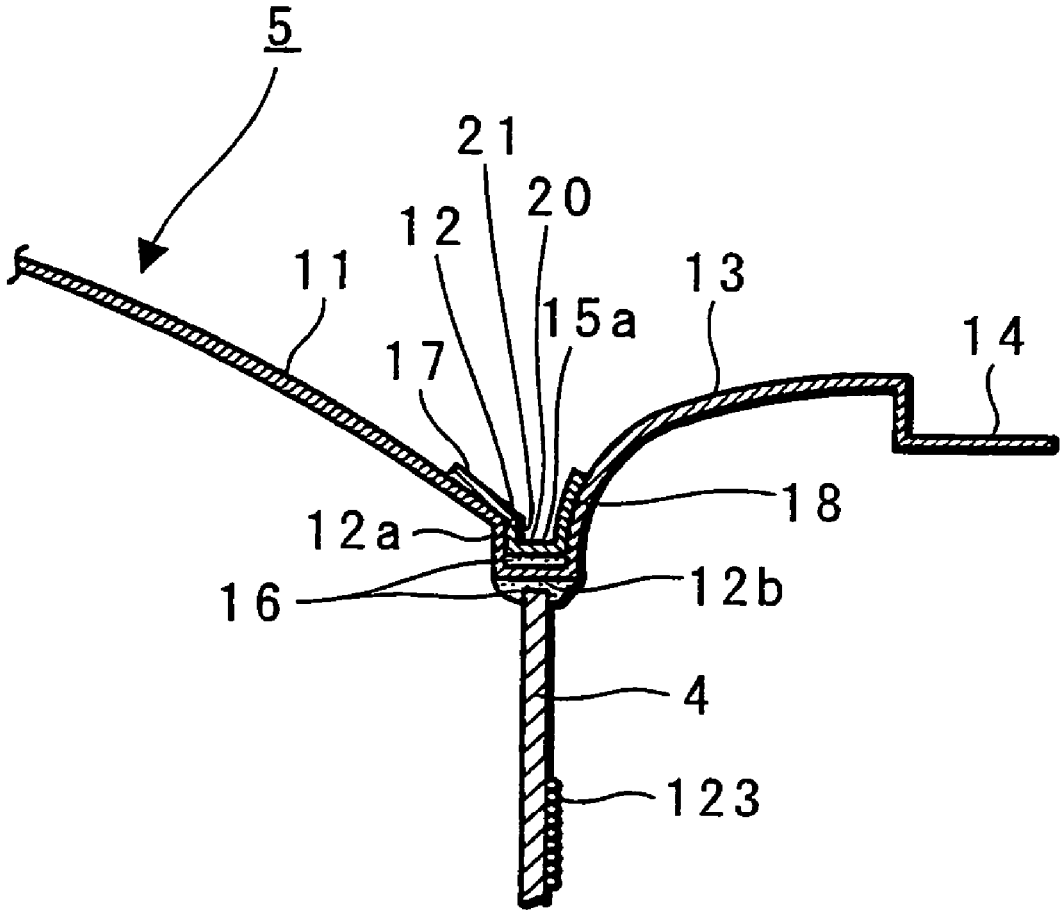
FIG. 9 is a sectional side view showing another construction of a part B in FIG. 7.

As shown in FIG. 9, a reinforcement ring used in this embodiment is joined from above or from under to: an inner circumferential portion 12*a* and a flat portion 12*b* of a junctional flat portion 12, a partly curved surface where the edge of the flat portion 12*b* extends along an edge-like diaphragm 13, and a partly curved surface where the upright periphery of the inner circumferential portion 12*a* of the junctional flat portion 12 extends along a domed diaphragm 11, of an acoustic diaphragm 5.

Specifically, regarding a reinforcement ring 15*a*, as shown in FIG. 8, an inner joined ring portion 17 and an outer joined ring portion 18, which are joined to part of the curved surface of the edge-like diaphragm 13 and part of the curved surface of the domed diaphragm 11 from above or from under, are integrally formed with a press processing or the like such that a joined portion 23 having a concave cross section is provided continuously at a reinforcement ring upright portion 21 and a reinforcement ring flat portion 20.

The reinforcement ring 15*a* as described above is stuck and fixed to the flat portion 12*b*, the inner circumferential portion 12*a*, and part of the domed diaphragm 11 and edge-like diaphragm 13 from under the junctional flat portion 12 with an adhesive 16 in between, as shown in FIG. 7.

Alternatively, as in FIG. 9, the reinforcement ring 15*a* is joined from above the junctional flat portion 12, with the adhesive 16 to the reinforcement ring flat portion 20. At the time of this joining, adhesive may be evenly applied to the joined portion 23 on the outside (on the bottom surface side) of all the portions including the inner joined ring portion 17, the reinforcement ring upright portion 21, the reinforcement ring flat portion 20 and the outer joined ring portion 18.

According to the above-mentioned construction of FIGS. 7 through 9, the reinforcement ring 15 whose width is equal to that of the junctional flat portion 12 is stuck and fixed to the junctional flat portion 12 and also in the vicinity thereof, and a bobbin 4 is fixed to the lower surface of the junctional flat portion 12 and the reinforcement ring flat portion 20, so that the mechanical strength of the junctional flat portion 12 and the vicinity thereof increases. The material of the reinforcement ring 15*a* may be the same as that of the acoustic diaphragm 5 and may be otherwise. If the material used is the same as that of the acoustic diaphragm 5, it is desirable that the thickness thereof be greater than that of the acoustic diaphragm 5. If the material used is different from that of the acoustic diaphragm 5, the thickness with which the strength of the part adhered becomes that of twice or more the thickness of the material of the acoustic diaphragm 5 is desirable.

In the above embodiment, a case in which the acoustic diaphragm 5 has been formed in advance and then the reinforcement rings 15 and 15*a* are joined to the diaphragm has been explained; however, it should be noted that laminating pressing may be simultaneously performed at the time when an acoustic diaphragm is formed. Needless to say, reinforcement rings may be respectively joined both from above and from under the junctional flat portion 12 of the acoustic diaphragm 5.

Figure 10:
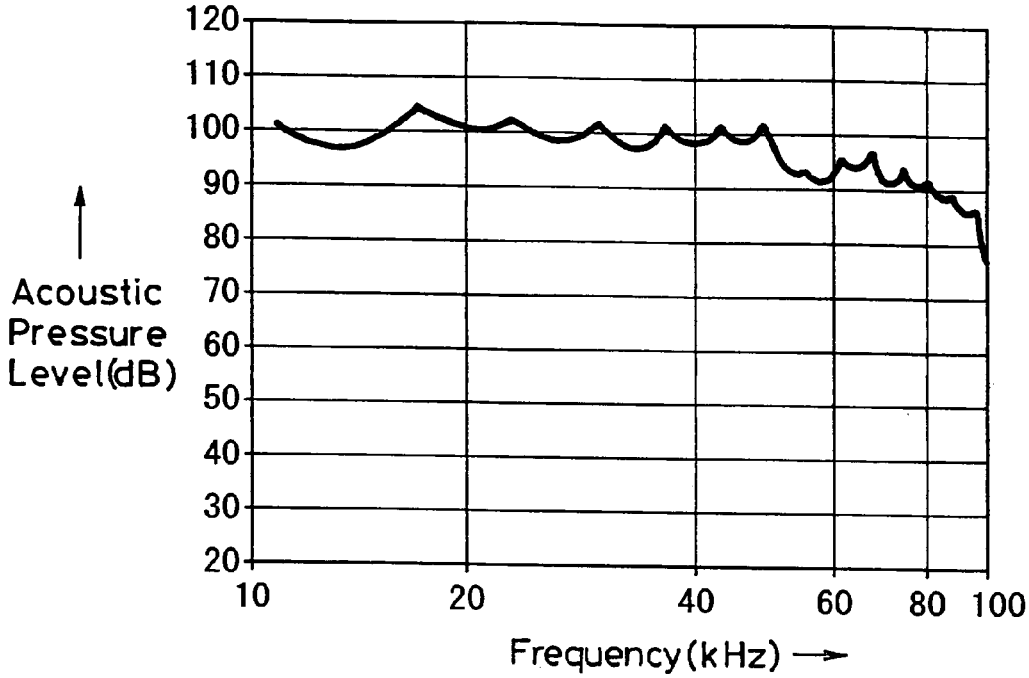
FIG. 10 is a characteristic curve showing the relation between acoustic pressure and frequency of a loudspeaker device of the present invention.
Figure 11:
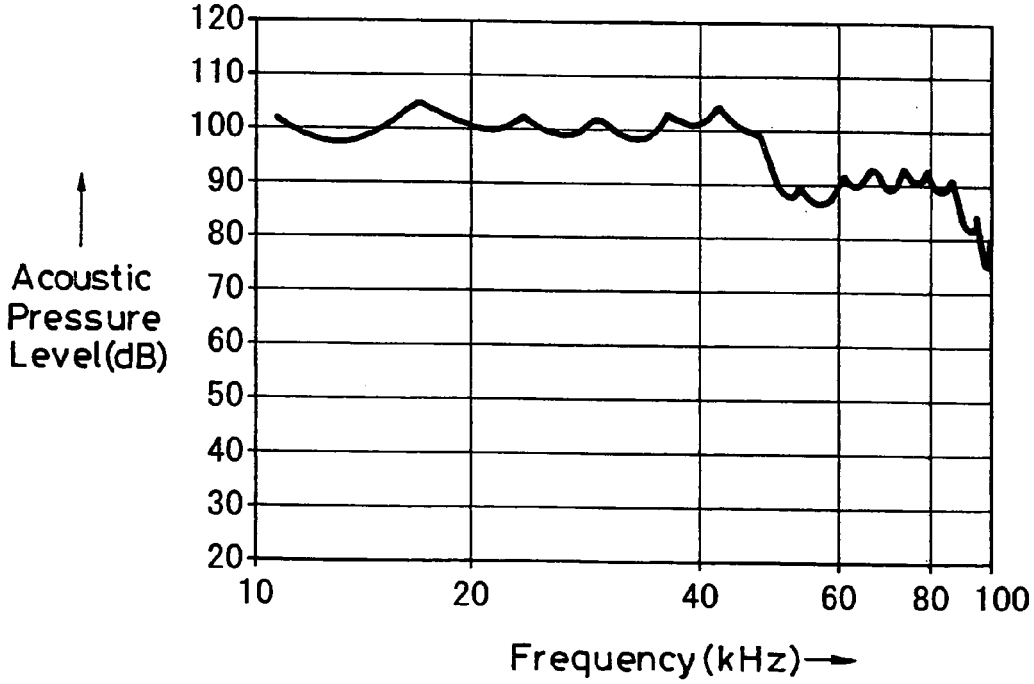
FIG. 11 Prior Art
FIG. 11 is a characteristic curve showing the relation between acoustic pressure and frequency of a conventional loudspeaker device.

Hereinafter, differences in characteristics between the present invention and a conventional device will be explained, using characteristic curves of FIGS. 10 and 11 showing the relation between acoustic pressure and frequency.

FIG. 10 shows the calculation result of the characteristic of the relation between acoustic pressure and frequency of the dynamic electromagnetic induction loudspeaker explained in FIG. 6A by means of the finite element method. The calculation is executed with the width w of the junctional flat portion of the acoustic diaphragm 5 being 0.25 mm, while the thickness w' of the bobbin 4 for a conductive 1-turn coil is 0.05 mm, using the same material and thickness as those of the acoustic diaphragm 5 with respect to the reinforcement ring 15. In FIG. 10, acoustic pressure level (dB) is plotted on the vertical axis against frequency from 10 kHz to 100 kHz on the horizontal axis.

According to the above-described characteristic of the relation between acoustic pressure and frequency, an approximately flat frequency characteristic is obtained from 10 kHz to 100 kHz; large level decrease in acoustic pressure are not seen at 40 kHz or under in comparison with an later-described conventional construction; and driving force from the bobbin 4 is efficiently transmitted to the edge-like diaphragm 13 without causing phase inversion or the like.

Further, in a similar calculation of the characteristic of the relation between acoustic pressure and frequency of the loudspeaker explained in FIG. 7 by means of the finite element method, approximately the same result is obtained concerning the characteristic curve showing the relation between acoustic pressure and frequency.

In this case, the calculation is executed with the material and the thickness of the reinforcement ring 15*a* that reinforces the junctional flat portion 12 and the vicinity thereof of the acoustic diaphragm 5 being the same as those of the diaphragm. The inner joined ring portion 17 and the outer joined ring portion 18, which are reinforcing portions in the vicinity of the junctional flat portion, are 1 mm in width. The width of the junctional flat portion 12 and the thickness of a voice bobbin are the same as those used in the calculation in FIG. 10. In this case also, it has been confirmed that large decrease in acoustic pressure at around 40 kHz are not seen, driving force from the voice bobbin is transmitted to the edge-like diaphragm and is efficiently converted to audio output similarly to the case of FIG. 10, and decrease in the acoustic pressure level in the range of 40 kHz to 100 kHz is improved in comparison with the reinforcement ring 15 shown in FIG. 4.

Figure 14:
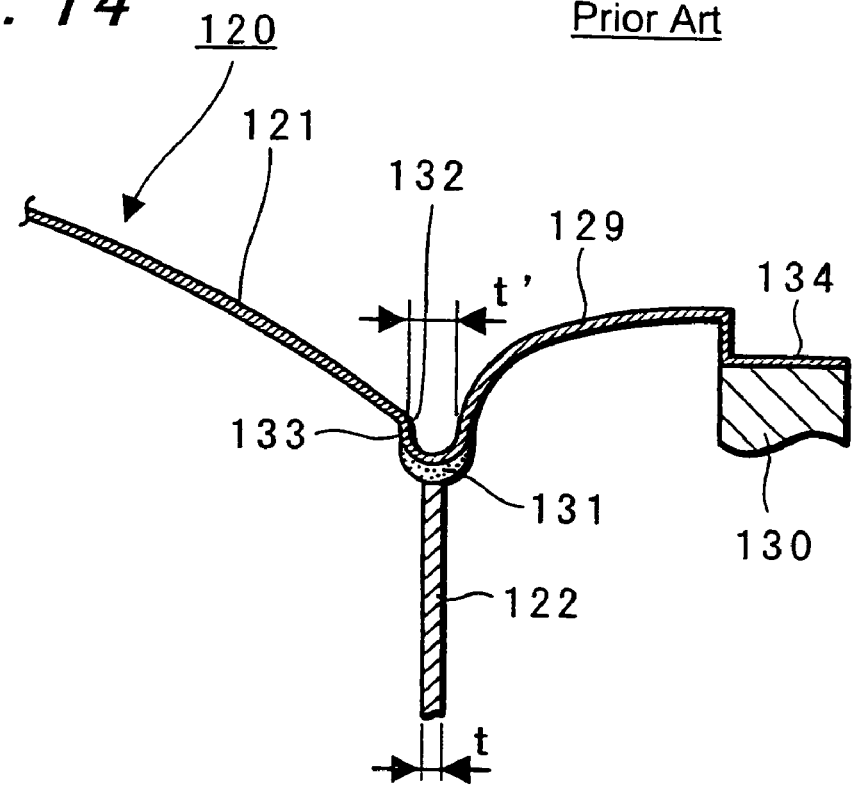
FIG. 14 is an enlarged sectional side view showing another construction of the part A in FIG. 12.

FIG. 11 shows the calculation result of the characteristic of the relation between acoustic pressure and frequency of the loudspeaker explained in FIG. 14 by means of the finite element method. This is a case in which the width of the junctional flat portion 132 is 0.25 mm, while the thickness of the bobbin 122 is 0.05 mm, which is considerably smaller. Sharp decrease in acoustic pressure is observed at 40 kHz or more. In this case, since the strength of the junctional flat portion 132 is insufficient, driving force provided by the bobbin 122 can not be transmitted satisfactorily to the edge-like diaphragm 129 at a high frequency 40 kHz or more, and therefore conversion from the acoustic diaphragm 120 to sound output can not be performed efficiently.

In the above-described construction, a case in which the reinforcement ring 15 shown in FIG. 4 and the reinforcement ring 15*a* shown in FIG. 8 are separately joined to the junctional flat portion 12 of the acoustic diaphragm has been explained; however, needless to say, the reinforcement rings 15 and 15*a* may be joined to the top and bottom of the junctional flat portion 12 or be combined into a single entity of triple structure.

According to the loudspeaker device of the present invention, a reinforcement ring is joined from above or from under a junctional flat portion or the vicinity thereof of a diaphragm having a junctional flat portion joining a domed diaphragm and an edge-like diaphragm in order to increase the strength, and driving means such as a voice coil is joined to the junctional flat portion or the junctional flat portion and the vicinity thereof and to the reinforcement ring, so that the mechanical strength of the junctional flat portion increases; unnecessary vibrations are removed; production is facilitated in comparison with the case in which adhesive is applied; conversion to sound output can be performed efficiently; and an dynamic loudspeaker device capable of reproducing up to high range of 100 kHz in an approximately flat manner can be obtained.

INDUSTRIAL APPLICABILITY

According to the present invention, as described above, the loudspeaker device can be provided as a loudspeaker suitable for a tweeter or the like, in which the quality of acoustic signals is excellent up to high range in a loudspeaker system.

The invention claimed is:

1. A loudspeaker device, comprising:

a domed diaphragm;

an edge-like diaphragm;

a junctional flat portion that joins said domed diaphragm and said edge-like diaphragm;

a conductive ring provided in a magnetic space to drive said domed diaphragm and said edge-like diaphragm;

a reinforcement ring that reinforces said junctional flat portion; and an adhesive that joins said conductive ring and said reinforcement ring to said junctional flat portion.

2. The loudspeaker device according to claim 1, wherein a bobbin with a voice coil constitutes a driving means and includes one end fixed to a joined portion.

3. The loudspeaker device according to claim 1, wherein the conductive ring constitutes a driving means and includes one end fixed to a joined portion.

4. A loudspeaker device according to claim 1, wherein a bobbin with the conductive ring constitutes a driving means and includes one end fixed to a joined portion.

5. The loudspeaker device according to claim 1, wherein said reinforcement ring is a flat-plate shaped ring joined to an inside of a depression that constitutes said junctional flat portion.

6. The loudspeaker device according to claim 1, wherein said reinforcement ring is a flat-plate shaped ring joined to an outside of a depression that constitutes said flat portion.

7. The loudspeaker device according to claim 1, wherein said reinforcement ring is a flat-plate shaped ring joined to an inside and outside of a depression that constitutes said flat portion.

8. The loudspeaker device according to claim 1, wherein said reinforcement ring includes an annular ring, part of which extends along said domed diaphragm or said edge-like diaphragm.

9. The loudspeaker device according to claim 8, wherein an annular rib disposed on an inner circumference of a depression that constitutes said junctional flat portion, part of which extends along said domed diaphragm and said edge-like diaphragm, is provided on an inner circumference of said reinforcement ring.

10. The loudspeaker device according to claim 8, wherein an annular rib disposed on an outer circumference of a depression that constitutes said junctional flat portion, part of which extends along said domed diaphragm and said edge-like diaphragm, is provided on an outer circumference of said reinforcement ring.

11. The loudspeaker device according to claim 1, wherein said reinforcement ring and said junctional flat portion are integrally formed.

12. A loudspeaker device, comprising:

a domed diaphragm;

an edge-like diaphragm;

a junctional flat portion that joins said diaphragm and said edge-like diaphragm;

a conductive ring provided in a magnetic space to drive said domed diaphragm and said edge-like diaphragm;

an inner joined ring portion that joins said domed diaphragm;

an outer joined ring portion that joins said edge-like diaphragm; and a reinforcement ring flat portion that joins said junctional flat portion.

13. The loudspeaker device according to claim 12, wherein said inner joined ring portion, said outer joined ring portion, and said reinforcement ring flat portion are integrally formed.

14. The loudspeaker device according to claim 12, wherein said inner joined ring portion, said outer joined ring portion, and said reinforcement ring flat portion are placed inside of a depression that constitutes said junctional flat portion.

15. The loudspeaker device according to claim 12, wherein said inner joined ring portion, said outer joined ring portion, and said reinforcement ring flat portion are placed outside of a depression that constitutes said junctional flat portion.

* * * * *